United States Patent [19]

Bauer

[11] Patent Number: 4,700,625

[45] Date of Patent: Oct. 20, 1987

[54] NEEDLE-CARRYING HEAD FOR A PRINTING MACHINE

[75] Inventor: Eric Bauer, Neuchatel, Switzerland

[73] Assignee: Caracteres S.A., Neuchatel, Switzerland

[21] Appl. No.: 787,962

[22] Filed: Oct. 16, 1985

[30] Foreign Application Priority Data

Oct. 30, 1984 [CH] Switzerland ..... 5179/84

[51] Int. Cl.[4] ..... B41J 3/12

[52] U.S. Cl. ..... 101/93.05; 400/124

[58] Field of Search ..... 101/93.04, 93.05, 93.29, 101/93.48; 400/124

[56] References Cited

U.S. PATENT DOCUMENTS

| | | | |
|---|---|---|---|
| 3,896,918 | 7/1975 | Schneider | 101/93.05 |
| 4,230,038 | 10/1980 | Hebert | 101/93.05 |
| 4,230,412 | 10/1980 | Hebert | 101/93.05 |
| 4,279,521 | 7/1981 | Kightlinger | 101/93.05 |
| 4,382,701 | 5/1983 | Davenport | 101/93.05 |
| 4,484,170 | 11/1984 | Wirth et al. | 400/124 |
| 4,572,070 | 2/1986 | Moulin | 101/93.05 |

FOREIGN PATENT DOCUMENTS

| | | | |
|---|---|---|---|
| 11273 | 2/1981 | Japan | 101/93.05 |

OTHER PUBLICATIONS

Lisinski et al.; "Double Density Line Printer Magnet Assembly"; *IBM Tech. Disc. Bull.;* vol. 23, No. 1, pp. 44–45; Jun. 1980.

*Primary Examiner*—Charles A. Pearson
*Assistant Examiner*—David A. Wiecking
*Attorney, Agent, or Firm*—Silverman, Cass, Singer & Winburn, Ltd.

[57] ABSTRACT

A needle-carrying head for a printing machine has needles controlled by electro-magnets. The coils of the electro-magnets are soldered to pins carried by support ears for the coils. The pins pass through printed circuit boards to which they are soldered. The coils are engaged on cores constituted by limbs of respective fork-shaped members the second limb of which serves to complete the magnetic circuit. The two limbs of each fork-shaped member are interconnected by means of a transverse portion constituting a yoke, secured by setting into one or the other of two plates forming, with a central plate made of plastics material, a cage-shaped frame of the needle-carrying head. The printed circuit boards are thus interposed between the electro-magnets and the front plate of the frame on the one hand, and between the electro-magnets and the rear plate on the other hand.

2 Claims, 5 Drawing Figures

NEEDLE-CARRYING HEAD FOR A PRINTING MACHINE

BACKGROUND OF THE INVENTION

Field of the Invention

The present invention relates to a needle-carrying head for a printing machine, the needles of which are controlled by electro-magnets.

One of the difficulties faced in the design and construction of such needle-carrying heads lies mainly in the general arrangement of their several component parts and in the mounting thereof, due to the multiplicity of these parts and the necessity of maintaining the construction as a whole very compact.

SUMMARY OF THE INVENTION

The object of the present invention is to furnish a solution to the foregoing difficulty.

This object is achieved due to the fact that in a needle-carrying head for a printing machine according to the invention the bobbins of the electro-magnets are provided with pins connected to the ends of the wires of their respective coils, these bobbins being mounted on at least one printed circuit board in which said pins are engaged, these pins being moreover connected to the conductive tracks of the printed circuit, and the cores of said electro-magnets are carried by at least one plate disposed parallel to the printed circuit board, the latter being interposed between the coils and the plate carrying the cores.

The various features of the invention will be apparent from the following description, drawings and claims, the scope of the invention not being limited to the drawings themselves as the drawings are only for the purpose of illustrating ways in which the principles of the invention can be applied. Other embodiments of the invention utilising the same or equivalent principles may be used and structural changes may be made as desired by those skilled in the art without departing from the present invention and the purview of the appended claims.

DESCRIPTION OF THE PREFERRED EMBODIMENT

The needle-carrying head illustrated is of the type intended to be fitted on the printing machine in a position such that the plane of the needles is inclined with respect to the writing direction, which enables a definition of the printed points to be achieved less than the distance which separates the needles one from another. A needle-carrying head of this type is disclosed in U.S. patent application Ser. No. 621,661 now U.S. Pat. No. 4,572,070, Feb. 25, 1985.

Figure 1:
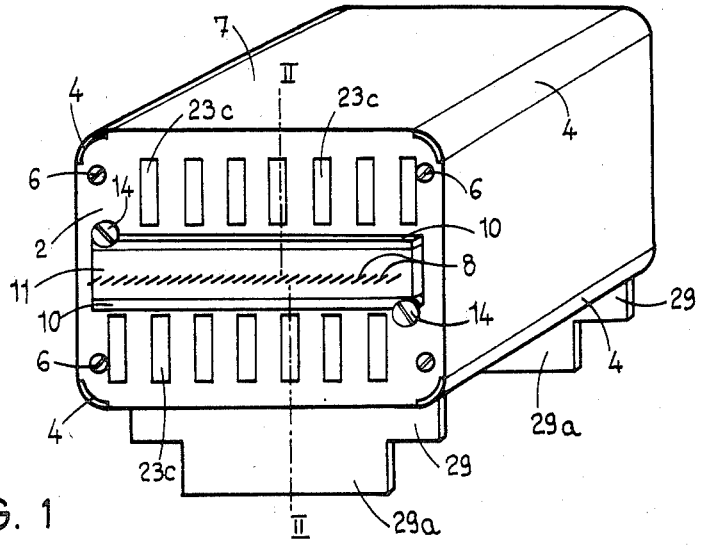
FIG. 1 is a perspective view of a needle-carrying head for a printing machine.

The needle-carrying head illustrated comprises an open-framework which can be described as cage-like, i.e. a box or enclosure having some open work. The open framework is formed by three plates arranged parallel, one relative to the others, i.e. a central plate 1 made of plastic material, a front plate 2 made of metal, for example of aluminum, and a rear plate 3 also made of aluminum. These plates are maintained at a distance from each other by corner pillars 4, constituting spacer or distance pieces the plates 1, 2 and 3 are assembled by means of screws 6 which function as braces for the open-framework. This frame is located in a casing 7 as shown in FIG. 1 to complete the needle-carrying head.

Figure 2:
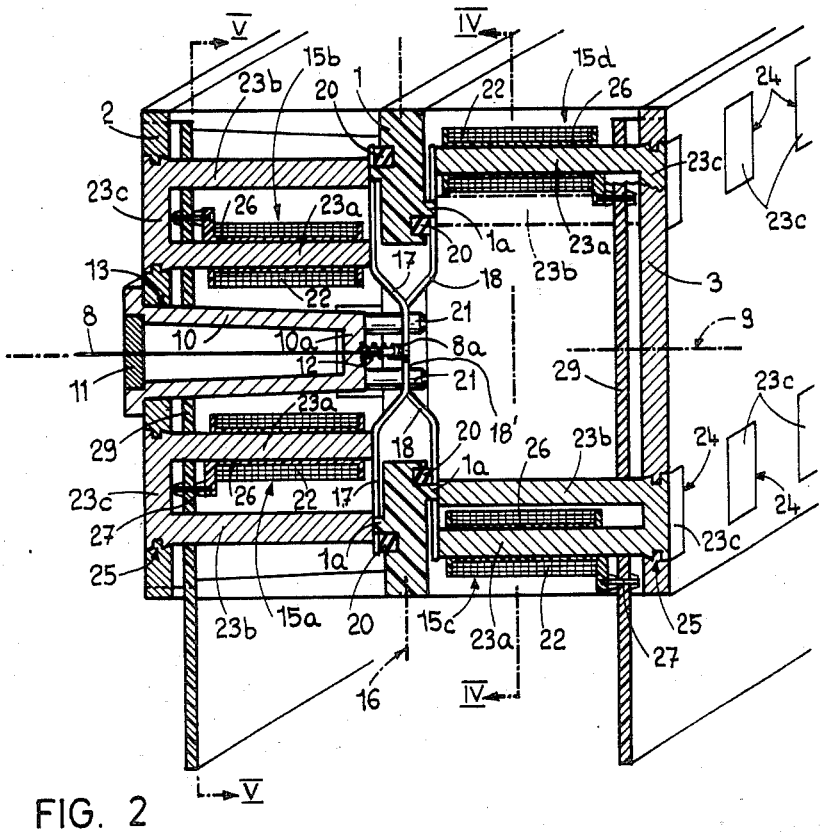
FIG. 2 is a perspective view of a part of the said head at a stepped vertical section, along line II—II of FIG. 1 but drawn to a larger scale than FIG. 1, said head being shown with a needle in extended condition.

The needles, designated by reference numeral 8, are arranged in a plane taken along a line designated by reference numeral 9 in FIG. 2, and are mounted for longitudinal slidable movement on an elongated needle support 10. Support 10 is of V-shaped cross section (FIG. 2). The bottom 10*a* of said support 10 is traversed by the needles and serves to guide the rear ends of the needles. The needle support 10 carries a small bar 11, made of plastics material, traversed by the needles and which serves to guide the latter at their front ends. Each needle 8 carries a coil-shaped return spring 12 mounted on its rear end, and which bears on the one hand against a head 8*a* of the rear end of the needle, and on the other hand against the part 10*a* of the needle support 10. The latter is engaged in an elongated opening 13 of the front plate 2 of the frame to which it is secured by means of screws 14 (FIG. 1).

The longitudinal movements of the needles 8 are controlled by electro-magnets 15*a*, 15*b*, 15*c* and 15*d* distributed in four groups of seven electro-magnets each. The electro-magnets 15*a* and 15*b* are disposed in front of a plane along a line designated by reference numeral 16 in FIG. 2, which plane is perpendicular to the needles, extending past the rear face of all the heads 8*a* of the needles, while the electro-magnets 15*c* and 15*d* are situated behind this plane 16. The electro-magnets 15*a* and 15*c* are situated below the plane 9 of the needles 8 while the electro-magnets 15*b* and 15*d* are situated above this plane.

The electro-magnets 15*a* and 15*b* act on their respective needles by means of control levers 17 while the electro-magnets 15*c* and 15*d* act on the needles by means of levers 18. The central plate 1 of the frame is provided with four rectilinear grooves in each of which is disposed a reed 20, of circular cross-section, extending slightly beyond the corresponding face of the plate 1. These reeds serve as the fulcrum points for the several levers 17 and 18 which can rock thereon.

The electro-magnets 15*a* and 15*b* are arranged head-to-foot with respect to the electro-magnets 15*c* and 15*d*, respectively. Consequently, it is necessary, so that their action on the needles be the same, that the levers 17 and 18 are not of the same type. Thus, levers 17 are of the third order type and levers 18 of the first order type. In the case of the electro-magnets 15*a* and 15*b* and of the levers 17, the electro-magnets are arranged at half distance between the fulcrum point 20 of the levers and the point of application of their force on the heads 8*a* of the needles while, in the case of the electro-magnets 15*c* and 15*d* and of the levers 18, the fulcrum points 20 are situated at $\frac{1}{3}$ of the distance between the electro-magnets and the point of application of their force on the needles. Hence, with identical electro-magnets energized by the same current, the force applied to the needles is the same in both cases.

The central plate 1 of plastics material is provided with pins 1*a* engaging notches provided in the levers 17 and 18 in the vicinity of their rear ends, each lever 17, 18 having a free end portion 17', 18' located closely proximate the said rear end of the needle which engagement maintains these levers laterally and longitudinally in position. The part 10*a* of the needle support 10 carries two sets of fingers 21, constituting two combs, engaged between the levers 17 and 18, in the vicinity of their free ends 17', 18', which maintains said ends 17', 18' against lateral movement. When the specific levers 17, 18 are articulated, i.e. rocked, about their respective fulcrum when the appropriate electromagnet is energized, the appropriate free end portion 17', 18' is forced against the appropriate head 8*a* at the rear end of the needle 8 driving that needle longitudinally.

The coils of the several electro-magnets 15*a* to 15*d*, designated 22, are traversed by cores of square cross-section constituted each by a limb 23*a* of a fork-shaped member, the second limb of which, designated 23*b*, is parallel to the limb 23*a* within the coil 22 and serves to complete the magnetic circuit. The bases of these members constitute yokes, designated 23*c*, of the electromagnets and are engaged in rectangular openings 24 of the front plate 2 and of the rear plate 3 in which they are located by setting in at 25.

Figure 3:
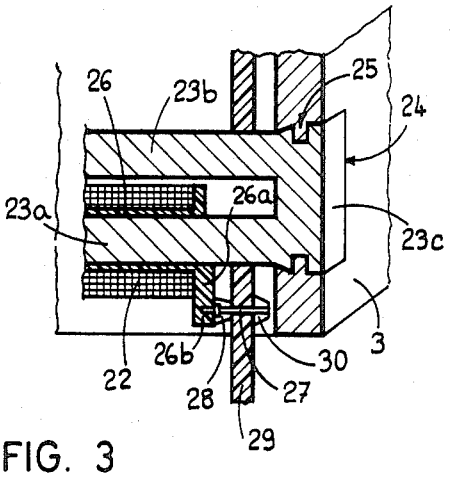
FIG. 3 shows a detail of FIG. 2 but drawn to a larger scale than FIG. 2.
Figure 4:
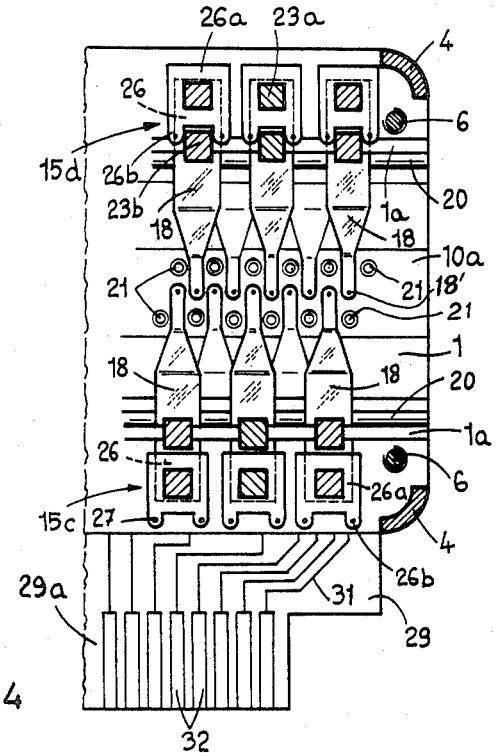
FIG. 4 is a partial sectional view along line IV—IV of FIG. 2.
Figure 5:
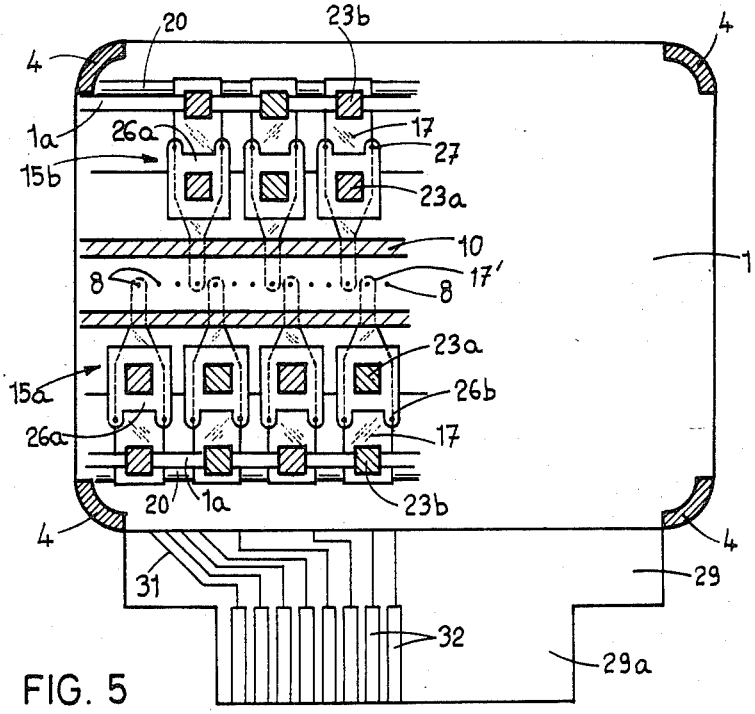
FIG. 5 is a sectional view along line V—V of FIG. 2.

The coils 22 are carried by bobbins 26, of square cross-section, one of the flanges of which, designated 26*a* (FIG. 3), is provided with two ears 26*b* carrying connecting pins 27 at the base of which the ends of the wires of the coils 22 are soldered at 28. These pins 27 pass through the boards, designated 29, of two printed circuits, which are interposed one between the front plate 2 and the electro-magnets 15*a* and 15*b* and the other one between the rear plate 3 and the electro-magnets 15*c* and 15*d*. The boards 29 of these printed circuits are disposed parallel to the three plates 1, 2 and 3 of the frame. The pins 27 are soldered at 30 (FIG. 3), at their ends, at the rear face of the boards of the printed circuits 29 at points electrically connected to the conductive tracks, designated by 31 (FIGS. 4 and 5), of the said circuits. These tracks connect to conductive surfaces 32 opposed on ears 29*a* of the printed circuit boards 29 situated outside the casing 7, thereby enabling mounting of the needle-carrying head on the printed machine merely by plugging in.

Due to the present described arrangement, the needle-carrying head constitutes a compact whole the multiple elements of which are easily manufactured and mounted. Thus, before the assembly of the case-shaped frame, the bobbins 26 are mounted on the printed circuit boards 29. The pins 27 are then soldered to the boards 29, then the complete bobbins provided with their coils carried by each board 29 is engaged on the cores 23*a* which are previously secured to the plates 2 and 3. These plates are then assembled to the central plate 1 on which the levers 17 and 18 have previously been mounted. The needle support 10, carrying the needles 8, is then mounted on the front plate 2, its fingers 21 for maintaining the levers against lateral movement, the fingers 21 being engaged between the latter.

What is claimed is:

1. In a needle-carrying head for a printing machine which head includes a bank of rectilinearly movable needles arranged in a common plane and having front and read ends, a printed circuit board having conductive tracks thereon, electromagnetic means driving each of the said needles respectively, said electromagnetic means constituting banks of electromagnets, each of the electromagnets including a bobbin, a wire coil on the bobbin and a core portion for mounting the bobbin, the wire coil having ends capable of being electrically connected to a selected one of the conductive tracks, said banks of electromagnets arranged in four groups, including a first group having members thereof disposed in front of a plane taken perpendicular to the needles, a second group arranged substantially parallel with respect to the members of the first group, members of the second group being arranged rearward of said perpendicular plane, selected ones of the first and second groups forming a third group, members of which are disposed above a horizontal plane passing through the axes of the needles and selected ones of the first and second groups forming a fourth group, members of which are disposed below the said horizontal plane; levers of the first and third order type respectively, the levers of the first order type and the levers of the third order type disposed for operation by ones of said electromagnet group, those of the electromagnets of the first group being arranged to act on the needles through the intermediary of said levers of the third order type while those of the electromagnets situated rearward of said perpendicular plane being arranged to act on the needles through the intermediary of said levers of the first order type; the improvement comprising:

an open framework for containing said electromagnet means and the levers, the needles and said printed circuit board mounted within said open framework, said open framework including a pair of parallel end plates, a center plate arranged between and parallel to said end plates including supporting pillars extending from both sides of said center plate with said end plates mounted thereto, the core portions being mounted on said end plates directed toward the center plate, a needle carrier for supporting said bank of needles and mounted to one of said end plates, said bank of needles extending toward said center plate, the rear ends of said needles being interior of said framework proximate said levers, and spacer means bridging the end plates and center plate and secured thereto, said printed circuit board being disposed between send end plates and the adjacent electromagnets, said levers being mounted to said center plate, each of said levers having a free end portion disposed proximate the respective rear ends of said needles, means on said center plate for establishing a fulcrum for said levers for the rocking of each of said levers on its respective fulcrum causing said free ends to act on the respective selected needle when the lever thereof is pivoted about its fulcrum upon energization of the selected electromagnet, each of said bobbins has ear formations at one end thereof and pin means for connecting said coil ends to the respective conductive track on the printed circuit board via said ear formations, resilient means at the rear ends of each needle for biasing same toward said lever end portions, energization of said electromagnets during said end portion against said bias moving said needle longitudinally in outward direction of said front plate.

2. The structure as claimed in claim 1 wherein when the lever is articulated about its fulcrum upon the associated electromagnet being energized, said free end is forced against the needle proximate thereto to effect longitudinal movement thereof.

* * * * *